US008047888B1

(12) United States Patent
Seymore

(10) Patent No.: US 8,047,888 B1
(45) Date of Patent: Nov. 1, 2011

(54) CHILD SEAT AUTOMOBILE MOTION SIMULATOR

(76) Inventor: Brent Seymore, Powell, OH (US)

( * ) Notice: Subject to any disclaimer, the term of this patent is extended or adjusted under 35 U.S.C. 154(b) by 215 days.

(21) Appl. No.: 12/456,276

(22) Filed: Jun. 15, 2009

Related U.S. Application Data

(60) Provisional application No. 61/131,849, filed on Jun. 13, 2008.

(51) Int. Cl.
*A47D 13/00* (2006.01)
*F16M 13/00* (2006.01)

(52) U.S. Cl. ..... 446/7; 472/95; 472/119; 472/36; 248/424

(58) Field of Classification Search ..... 446/7; 472/95, 472/119, 36; 248/424
See application file for complete search history.

(56) References Cited

U.S. PATENT DOCUMENTS 5,147,109 A 9/1992 Jolly
5,183,457 A * 2/1993 Gatts et al. ..... 600/21
5,238,455 A 8/1993 Cain et al.
5,398,353 A * 3/1995 Sachathamakul ..... 5/109
D417,568 S 12/1999 Pike
6,155,833 A 12/2000 Lenihan
6,431,872 B1 8/2002 Shiraishi et al.
6,533,670 B1 3/2003 Drobnis
6,574,806 B1 6/2003 Maher
7,422,524 B2 * 9/2008 Gregorian ..... 472/119
7,551,100 B1 * 6/2009 Salley et al. ..... 340/692
7,717,798 B2 * 5/2010 Bellows et al. ..... 472/36
2002/0113469 A1 * 8/2002 Stern et al. ..... 297/256.16

* cited by examiner

*Primary Examiner* — Gene Kim
*Assistant Examiner* — Michael Dennis
(74) *Attorney, Agent, or Firm* — Montgomery Patent & Design; Robert C. Montgomery; Joseph T. Yaksich

(57) ABSTRACT

An apparatus that mimics the physical effects of riding in a motor vehicle comprising a base structure on which a child automobile seat may be mounted to sooth an occupying child is herein disclosed. A top platform is laterally and longitudinally motioned by bottom mounted motion generating motor assemblies by means of supporting springs. A standard child's automobile seat can be fastened with the use of an integral seat belt. The apparatus is controlled by a microprocessor-based control system, which activates the motors to reproduce a gentle rocking, bumping, swerving or other motion commonly experienced in a motor vehicle. Additionally, the apparatus comprises a sound system capable of producing soothing music and a plurality of sounds designed to mimic those heard in a motor vehicle.

11 Claims, 5 Drawing Sheets

CHILD SEAT AUTOMOBILE MOTION SIMULATOR

RELATED APPLICATIONS

The present invention was first described in and claims the benefit of U.S. Provisional Patent No. 61/131,849 filed Jun. 13, 2008, the entire disclosures of which are incorporated herein by reference.

FIELD OF THE INVENTION

The present invention relates generally to child seats, and more particularly, to a child seat for providing a simulated motion of an automobile for small children that calms and aids in lulling the child to sleep.

BACKGROUND OF THE INVENTION

Infants and young children love to be rocked to sleep. This love begins within the arms of their parents, followed by baby rockers and bouncer seats and even to rocking toys, such as a hobby horse. It is evident that rocking motions sooth and calm young children, particularly when a child is placed in a car seat and taken on a trip in a motor vehicle. The movement and sounds generated by the vehicle seem to work magic on fussy or crying babies. Within minutes they are sound asleep and frequently remain so for the entire trip. In fact, many parents and professionals advise that taking a young child on a short car ride is a guaranteed method inducing sleep. While various items attempt to mimic a rocking motion inside the home, nothing seems to work as well as a car ride. Some parents, faced with a particularly fussy child, do indeed end up taking their child for a ride to calm them and get them to sleep. This method of calming a child may be effective but it can be incredibly inconvenient, can be expensive with the rising cost of gasoline, and can be dangerous for a tired parent to drive in the middle of the night.

Various attempts have been made to overcome this problem and provide a suitable seat or rocking device for the calming of young children. These attempts can be seen by reference to several U.S. Patents, including U.S. Pat. No. 5,147,109, issued in the name of Jolly, which describes a car seat apparatus for securing a child to a vehicle seat that utilizes a sound reproducing mechanism to induce the child to be secured and harnessed in the car seat apparatus.

U.S. Pat. No. 5,238,455, issued in the name of Cain, Jr. et al., describes an omni-directional rocking apparatus comprising a rocking base and a seating assembly to provide a rocking toy that simulates an animal body, vehicle, or the like.

U.S. Pat. No. 6,574,806, issued in the name of Maher, describes an infant seat rocking device that provides a rocking motion to an infant which doesn't rely on the movement of the infant or a parent seated nearby. The Maher device comprises a seat and a seat moving assembly which uses the rotation of a crank arm to pull on the seat to provide the rocking motion.

Another solution attempt to provide a means of simulating ground travel by attaching a drive mechanism to a child's ride-on vehicle toy as seen in U.S. Pat. No. 6,155,833, issued in the name of Lenihan, which describes a ride simulator for use with a children's ride-on vehicle.

Among the relevant attempts to provide vehicle ride simulations for amusement purposes are several U.S. Patents, including U.S. Pat. No. 6,431,872, issued in the name of Shiraishi et al., which describes a drive simulation apparatus and U.S. Pat. No. 6,533,670, issued in the name of Drobnis, which describes an amusement ride with pivotable motion base.

Additionally, ornamental designs for car seats and seat bases exist, particularly, U.S. Pat. No. D 417,568. However, none of these designs are similar to the present invention.

While these devices fulfill their respective, particular objectives, each of these references suffers from one or more deficiencies related to effectively reproducing the combination of sounds and motions provided by a moving vehicle. Accordingly, there exists a need for a means by which the movement and sounds as generated by a moving motor vehicle can be simulated in the home for the purposes of calming and helping a child to sleep. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to effectively and practically provide a young child with a simulated ride in a vehicle to induce a calm sleeping state and thus, the object of the present invention is to provide for this need.

To achieve the above objectives, it is an object of the present invention to provide a child seat automobile motion simulator that mimics the physical effects of riding in an automobile by transferring a dual-axis rotary eccentric motion to a small child secured within an attached automobile seat assembly and to provide associated vehicle sounds reproducing a gentle rocking or other motions commonly experienced in an automobile in order to calm the child and induce a sleeping state without the need to transfer the child to a vehicle and drive the vehicle for a period of time.

Another object of the child seat automobile motion simulator is to provide an apparatus comprising a base assembly with a seat belt that enables a standard child automobile seat to be securely affixed, a microprocessor-based control module. The child automobile seat assembly is securely mounted to an upper base section via upturned outer edge regions forming a "U"-shaped structure which comprises a central horizontal platform surface with a rubber anti-skid pad and six (6) attachment loops equally-spaced across a forward and a rearward edge. A lower base section comprises a rectangular enclosure that stabilizes the apparatus and provides a housing to internal equipment and components that provide the soothing motion to the upper base section with the attached car seat. Speakers emit desired sounds to the child when seated in the attached car seat assembly.

Yet still another object of the child seat automobile motion simulator is to provide an apparatus comprising a front control panel having a motion control switch, a sound control switch, a selector switch, an analog sound interface, and a digital audio interface. The motion control switch controls the motion of the upper base section and provides a means to produce various motion effects by synchronously controlling the amplitude and the frequency of internal eccentric elements.

Yet still another object of the child seat automobile motion simulator is to provide an apparatus comprising a lower support enclosure, four (4) isolation springs, an x-axis electric motor, an x-axis eccentric element, a y-axis electric motor, a y-axis eccentric element, a control module, and a' sound generation module. The upper base section is supported by the four (4) isolation springs that are arranged at the four (4) corner areas. The isolation springs enable the motion of the upper base section in a horizontal plane. The eccentric elements are rotated by respective axial-connected x-axis and y-axis electric motors via vertical shafting.

Yet still another object of the child seat automobile motion simulator is to provide a method of utilizing the apparatus which provides the ability to mimic the physical and audible effects of traveling in an automobile for small children which allows them to quickly and easily fall asleep with gentle rocking motions as well as soothing sounds.

Yet still another object of the child seat automobile motion simulator is to provide an apparatus that is primarily utilized at a home of a child and may be taken on trips away from home for use in other locations.

Further objects and advantages of the child seat automobile motion simulator will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
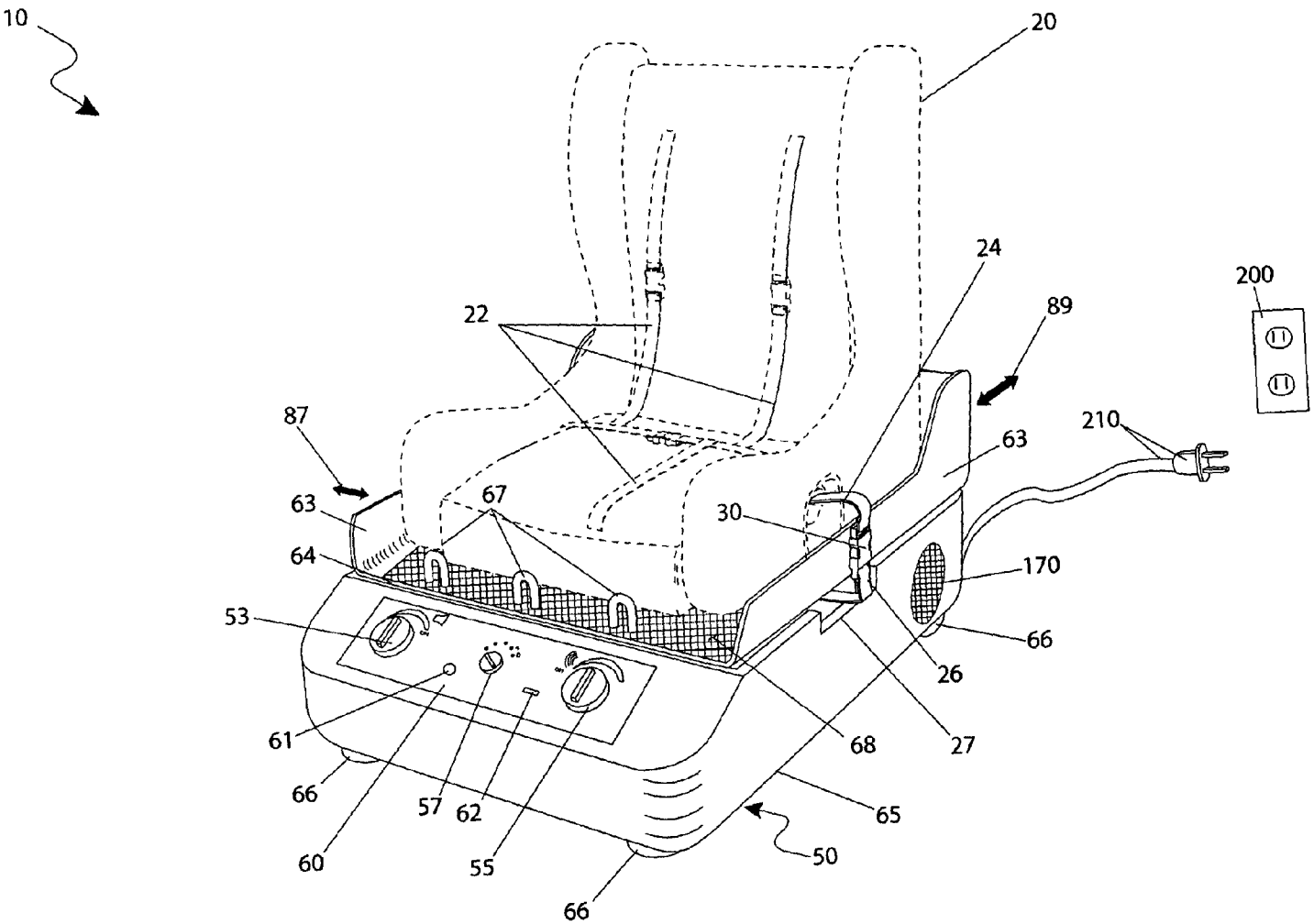
FIG. 1 is a right-hand perspective view of a child seat automobile motion simulator 10 depicted here in a utilized state with a conventional child automobile seat 20, according to the preferred embodiment of the present invention.

10 child seat automobile motion simulator
20 child automobile seat assembly
22 seat restraint
24 seat belt tunnel
26 seat belt
27 belt slot
28 anchor bracket
30 female buckle portion
32 male buckle portion
50 base assembly
53 sound control switch
55 motion control switch
57 selector switch
60 front control panel
61 analog sound interface
62 digital sound interface
63 upper base section
64 platform surface
65 lower base section
66 foot pad
67 attachment loop
68 anti-skid pad
80 lower support enclosure
85 isolation springs
87 lateral motion
89 longitudinal motion
90 spring anchor
95 x-axis electric motor
100 x-axis eccentric element
110 y-axis electric motor
115 y-axis eccentric element
125 control module
127 first slotted coupling
128 second slotted coupling
130 interconnecting wiring
135 sound generation module
170 speaker
200 standard wall outlet
210 power cable
220 common fastener

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a child seat automobile motion simulator (herein described as the "apparatus") 10, which comprises a platform 64 that mimics and transmits simulated physical motions of riding in an automobile thereto a child occupying a child seat 20 affixed thereto. The soothing motions are created using a rotary eccentric device which provides a longitudinal motion 89 and a lateral motion 87. The apparatus 10 comprises a top platform 64 further comprising a seat belt 26 allowing a standard child automobile seat 20 to be affixed securely thereto. The apparatus 10 is controlled by a microprocessor-based control module 125, thereby reproducing a gentle rocking, bumping, swerving or other motions 87 commonly experienced in an automobile. Additionally, the apparatus 10 also comprises a sound module 135 capable of producing a series of soothing sounds as well as receiving and emitting various entertaining sounds via an audio equipment interface.

Figure 2:
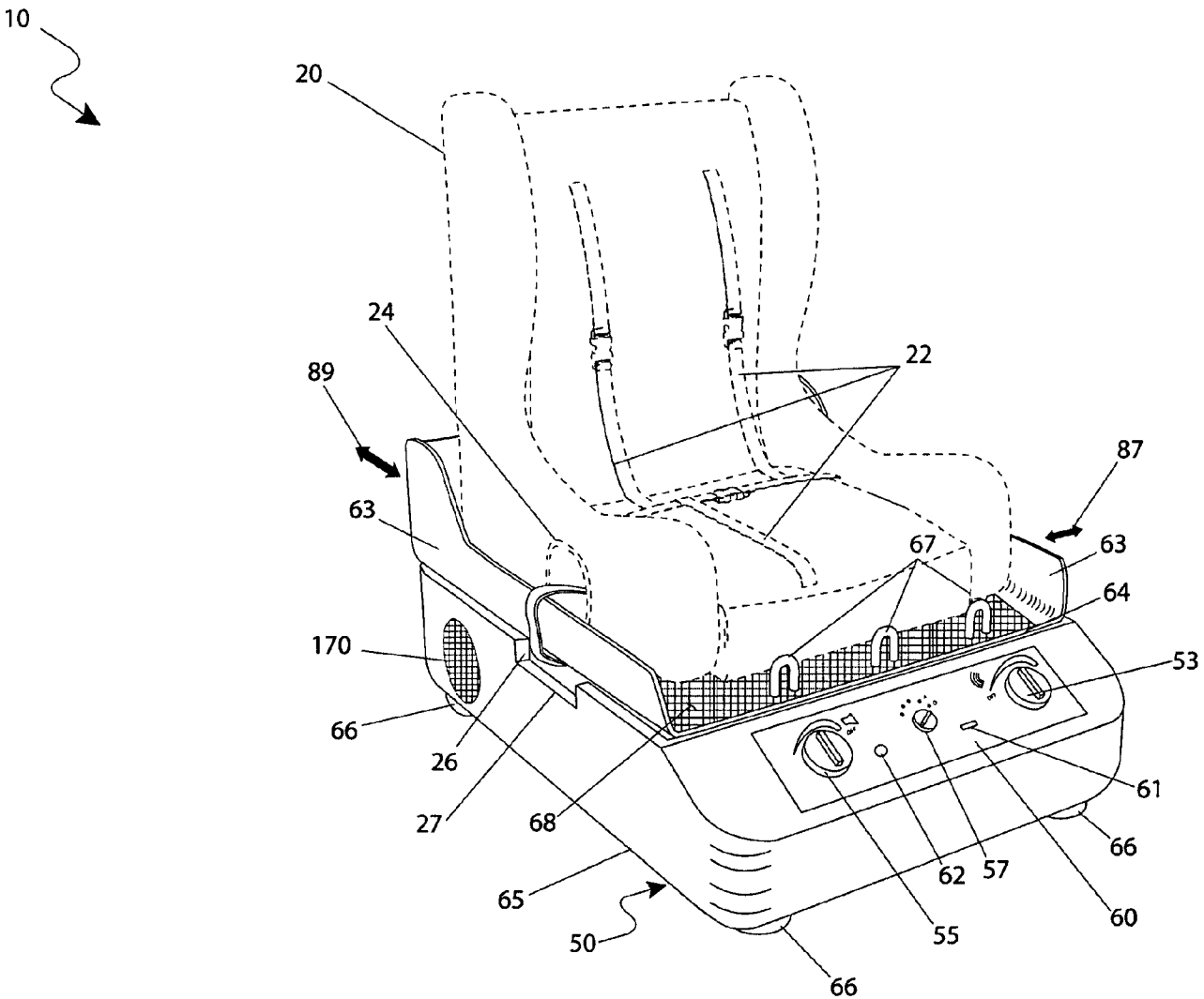
FIG. 2 is a left-hand perspective view of a child seat automobile motion simulator 10, according to the preferred embodiment of the present invention.

Referring now to FIGS. 1 and 2, perspective views of the apparatus 10 depicted here in a utilized state with a conventional child automobile seat 20, according to the preferred embodiment of the present invention, are disclosed. The apparatus 10 comprises a base assembly 50 which further comprises an upper base section 63 and a lower base section 65. The upper base section 63 provides a secure mounting means thereto the child automobile seat assembly 20 via upturned outer edge regions to form a "U"-shaped structure that cradles the child automobile seat assembly 20. Additionally, said upper base section 63 also comprises a central horizontal platform surface 64 therebetween the aforementioned upturned edges and having a rubber anti-skid pad 68 affixed thereto said platform surface 64 preferably using common adhesives. The upper base section 63 further comprises a seat belt 26 which provides an attaching means thereto the child automobile seat assembly 20. Attachment of the child automobile seat assembly 20 using the seat belt 26, is envisioned to emulate installation of a child automobile seat 20 therewithin an automobile. The upper base section 63 further comprises six (6) attachment loops 67 with three (3) said loops 67 arranged therein an equally-spaced manner thereacross forward and rearward edges. Said attachment loops 67 comprise inverted "U"-shaped appendages to facilitate fastening of a wide variety of child automobile seat assemblies 20 having different configurations of hooks, straps, attachment points, and the like. Said attachment loops 67 are preferably integrally molded thereinto the upper base section 63 or may be fastened thereto using common fasteners such as rivets, screws, or the like. A typical installation of the child automobile seat assembly 20 is shown here; however, it is understood that the seat belt portion 26 may be utilized to affix said child automobile seat assembly 20 thereto the apparatus 10 using the seat belt 26 or the attachment loops 67, or a combination of both based upon particular child automobile seat assembly 20 designs and as such should not be interpreted as a limiting factor of the apparatus 10.

The seat belt 26, as depicted here, comprises two (2) joined strapping portions which are anchored thereto opposing outside surfaces along a bottom surface of the upper base section 63; routed therethrough respective belt slot portions 27 formed along side upper edges of the lower base section 65; routed therethrough a seat belt tunnel portion 24 integral thereto the child automobile seat assembly 20; and, locked thereat end portions via a female buckle portion 30 and a male buckle portion 32. The seat belt 26 comprises standard braided synthetic strapping with side-release buckle fittings (see FIG. 3).

The upper base section 63 is mechanically isolated therefrom the lower base section 65 via a physical gap of approximately one-half (½) inch and supported thereby four (4) isolation springs 85 which allow said upper base section 63 to move independently therefrom said lower base section 65 during activation of the aforementioned soothing motions 87, 89.

The child automobile seat assembly 20 is envisioned to be of a conventional design; however, other seating equipment may be utilized therewith the apparatus 10 such as various automobile seats, infant seats, child carriers, or the like. While the description and figures indicate a full size automobile seat 20 having standard restraint straps 22, such usage is for illustrative purposes only and is not intended to be a limiting factor of the apparatus 10.

The lower base section 65 comprises a front control panel 60, a belt slot 27, four (4) foot pads 66, and a pair of speakers 170. The lower base section 65 provides a rectangular enclosure approximately twenty-four (24) inches long and eighteen (18) inches wide, thereby stabilizing the apparatus 10 as well as providing an enclosure thereto included equipment and components which provide the aforementioned soothing motion 87 thereto the upper base section 63 (see FIG. 4). The speakers 70 are preferably located along a rearward portion of side surfaces of the lower base section 65; however, other locations of said speakers 170 may be utilized to produce different sound effects and as such should not be interpreted as a limiting factor of the apparatus 10. The speakers 170 provide projection of emitted audio sounds thereto the child's ears when seated therein the child automobile seat assembly 20. Such localizing of said sounds may also reduce an ambient audible volume of noise that others in the vicinity of the apparatus 10 may be subjected to.

The lower base section 65 further comprises the front control panel 60 being located along an upper front surface thereof said lower base section 65 along an inclined portion thereof, thereby providing a convenient viewing and operating surface angle thereto a user. The front control panel 60 comprises a motion control switch 55, a sound control switch 53, a selector switch 57, an analog sound interface 61, and a digital audio interface 62. The motion control switch 55 is used to initiate and control an intensity of the motion 87 of the upper base section 63 therein a horizontal plane in relationship to the lower base section 65 of the apparatus 10. The motion control switch 55 provides a means to produce various motion effects 87 by synchronously controlling amplitude and frequency characteristics of internal motion generating eccentric elements 100, 115 (see FIG. 4). The sound control switch 53 and selector switch 57 provide a volume control means and selection of various sounds and audio inputs, respectively, which are subsequently emitted therefrom the side-mounted speakers 170.

The lower base section 65 provides additional lateral stability via four (4) foot pads 66 mounted thereto a bottom surface and arranged thereat respective corner locations. Said foot pads 66 comprise cylindrical-shaped elements made using a rubber substance and affixed thereto said lower base section 65 using common fasteners being similar in construction to like devices used on small appliances. Said foot pads 66 provide a high-friction grip on a supporting surface as well as acting to absorb vibration generated thereby the apparatus 10 during normal use.

The selector switch 57 enables a user to select multiple pre-recorded sounds as well as particular external audio input devices connected thereto via the analog 61 and digital 62 sound interfaces. Said sound interfaces 61, 62 are envisioned to comprise device connectors such as, but not limited to: USB, phone jack, RCA, mini plugs, HDMI, and the like. Said pre-recorded sounds are envisioned to include sounds such as, but not limited to: wind noise, tire noise, engine noise, and the like. Said features provide the apparatus 10 the ability to mimic the physical and audible effects of traveling in an automobile. It is further envisioned that other pre-recorded sounds may also include children songs, nursery rhymes, and the like. The sound 53 and motion 55 control switches are envisioned to be common rheostatic rotary devices or equivalent control devices capable of providing a variable analog signal thereto the microprocessor-based control module 125 (see FIG. 4). The selector switch 57 is envisioned to be a common multi-position selector switch, thereby conducting a selected signal thereto the control module 125 (see FIG. 4). Said switches 53, 55, 57 further comprise corresponding function-indicating indicia being molded therein or painted thereupon the front control panel 60.

It is envisioned that the apparatus 10 would be primarily utilized therewithin a residence or home of a child, although it may be taken on trips away from home for use in other houses or buildings. It should be understood that the apparatus 10 is not intended for use in automobiles.

Figure 3:
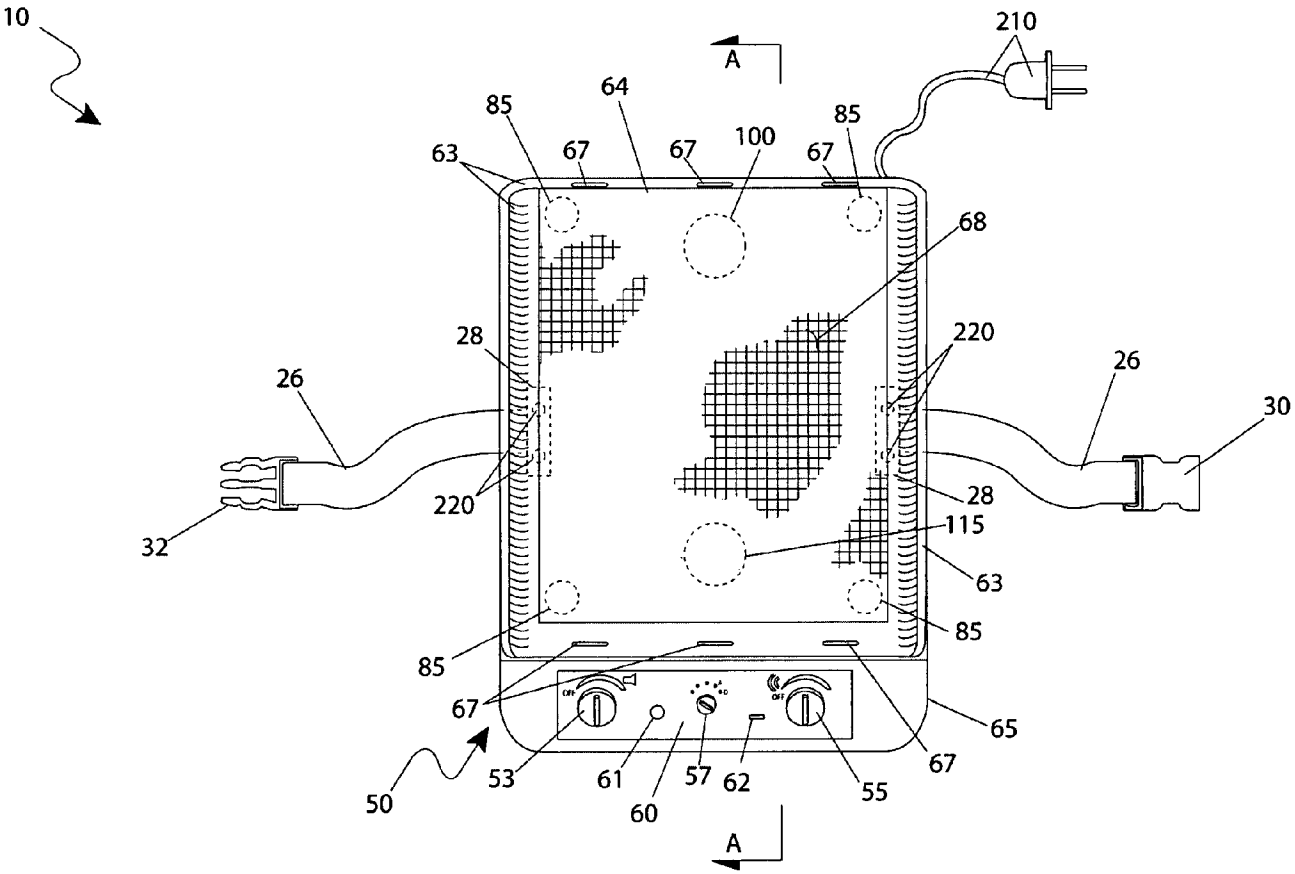
FIG. 3 is a top view of the child seat automobile motion simulator 10, according to the preferred embodiment of the present invention.

Referring next to FIG. 3, a top view of the motion simulator for child automobile seats 10, according to the preferred embodiment of the present invention, is disclosed. The apparatus 10 comprises a seat belt 26, further comprising a female buckle portion 30, male buckle portion 32, and a pair of anchor brackets 28. Said seat belt 26 provides additional stability and restraining security thereto the child automobile seat assembly 20 and occupying child and is envisioned being made using strong nylon strapping materials. The female 30 and male 32 buckle portions are affixed thereto end portions of said seat belt 26 using conventional sewing techniques thereby providing standard side-release quick-connect fittings or equivalent securing fastening means. Said female 30 and male 32 buckle portions further provide length adjusting features, thereby allowing a user to synch said seat belt 26 being routed therethrough the seat belt tunnel portion 24 to obtain a firm attachment of the child automobile seat assembly 20 (see FIG. 1).

Figure 4:
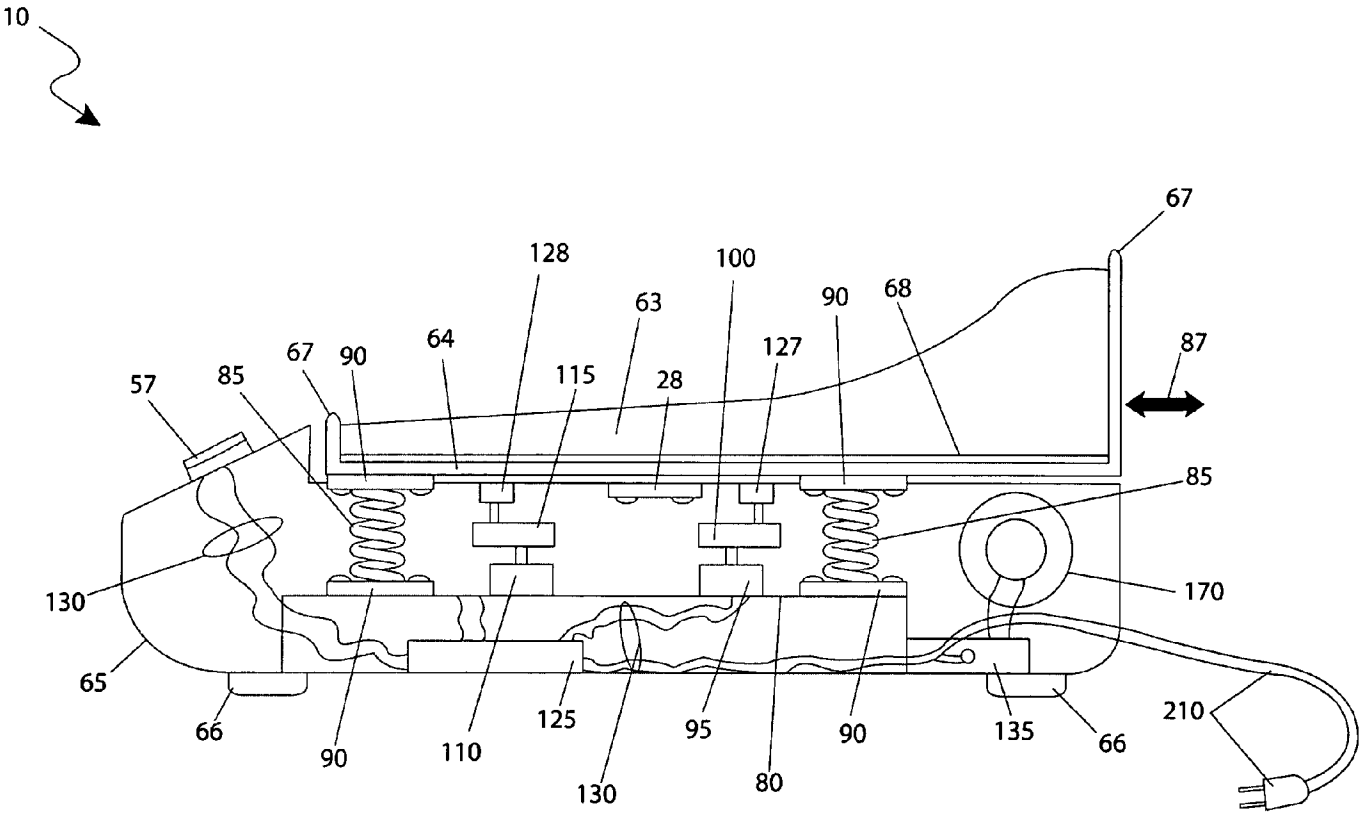
FIG. 4 is a sectional view of the child seat automobile motion simulator 10 taken along section A-A (see FIG. 2), according to the preferred embodiment of the present invention; and, FIG. 5 is an electrical block diagram depicting the electrical components as used with the child seat automobile motion simulator 10, according to the preferred embodiment of the present invention.

Referring now to FIG. 4, a sectional view of the apparatus 10 as seen along a line A-A (see FIG. 3), according to the preferred embodiment of the present invention, is disclosed. The apparatus 10 comprises a lower support enclosure 80, four (4) isolation springs 85, an x-axis electric motor 95, an x-axis eccentric element 100, a y-axis electric motor 110, a y-axis eccentric element 115, a control module 125, and a sound generation module 135. The platform surface portion 64 of the upper base section 63 is supported thereby by the four (4) isolation springs 85 being arranged thereat respective four (4) corner areas (see FIG. 3). The isolation springs 85 allow a motioning of said upper base section 63 in a horizontal plane therewithin physical lateral limitations of said isolation springs 85. The isolation springs 85 are envisioned to allow the upper base section 63 to move approximately one-half (½) inch in both the x and y axis (as viewed from above).

The lower support enclosure 80 comprises an enclosed plastic rectangular structure internal thereto the lower base section 65 and being affixed thereto along an interior bottom surface using common fastening means such as adhesives, welding, fasteners, or the like. The lower support enclosure 80 provides a housing thereto electrical and electronic components necessary thereto the operation of the apparatus 10, as well as acting as a support thereto the upper base section 63 via the isolation springs 85.

The lower support enclosure 80 provides attachment thereto said isolation springs 85 being positioned thereat a horizontal orientation, via spring anchors 90. Said spring anchors 90 are affixed thereto each end portion of each isolation spring 85 preferably utilizing a welded connection thereto, thereby providing a horizontal flanged surface with which to mount said isolation spring 85 thereto the upper base section 63 and lower support enclosure 80 using common fasteners 220 such as rivets, screws, or the like.

The lower support enclosure 80 also provides an attachment means thereto the x-axis 100 and y-axis 115 eccentric elements. The eccentric element 100, 115 are rotated by respective axial-connected x-axis 95 and y-axis 110 electric motors being in mechanical communication therewith via vertical shafting, thereby functioning in a similar manner as common rotary vibrators found in cellular telephones. Each electric motor 95, 110 is securely attached thereat a lower end portion thereto a top surface portion of the lower support enclosure 80 using common fastening means such as adhesives, welding fasteners, or the like. Likewise, each eccentric element 100, 115 is affixed thereat an upper end portion thereto a bottom surface of the upper base section 63 via a first slotted coupling 127 and a second slotted coupling 128, respectively. The first slotted coupling 127 coverts the purely rotational aspect of the x-axis eccentric element 100 thereinto a lateral motion 87 and the second slotted coupling 128 coverts the purely rotational aspect of the y-axis eccentric element 115 thereinto a longitudinal motion 89. The slotted couplings 127, 128 are arranged at right angles with respect to each other, thereby resulting in respective lateral motion 87 and longitudinal motion 89. Each slotted coupling 127, 128 comprises a "T"-shaped slot-and-pin design, thereby retaining the upper base section 63 should the apparatus 10 be lifted using the upper base section 63 as a handle or if lifted thereby the child automobile seat assembly 20. Each slotted coupling 127, 128 is securely attached thereto a bottom surface of the upper base section 63 using common fastening means such as adhesives, welding fasteners, or the like.

When activated by the aforementioned motion control switch 55, the electric motors 95, 110 would rotate the respective eccentric elements 100, 115 in an eccentric manner therewithin the slotted couplings 127, 128, thereby transmitting the resultant lateral motion 87 and longitudinal motion 89 thereto the upper base section 63 and subsequently thereto the child automobile seat assembly 20.

The electric motors 95, 110 receive electrical power therefrom a control module 125 which comprises electrical and electronic components such as circuit boards, relays, microprocessors, embedded software, and the like, thereby producing a variety of synchronized motions 87, 89 such as gentle rocking, bumping, swerving, vibrating, or other simulated motion patterns 87, 89. The control module 125 receives a desired amplitude signal therefrom the rotary motion control switch 50 via interconnecting wiring 130.

The sound generation module 135 provides internal electronics common in the industry capable of producing and conducting multiple sound effects such as that of tire noise, wind noise, nursery rhymes, melodies, or the like, therefrom the aforementioned speakers 170. The sound generation module 135 provides a housing means thereto various electronic components such as circuit boards, relays, amplifiers, microprocessors, embedded software, an analog to digital convertor, and the like, being necessary to produce the aforementioned sounds. Additionally, said sound generation module 135 is in electrical communication therewith the aforementioned analog 61 and digital 62 sound interfaces, the selector switch 57, and the two (2) speakers 170, via additional interconnecting wiring 130. The analog 61 and digital 62 sound interfaces allow connection of various peripheral audio devices such as CD players, IPODs™, MP3 players, and the like. Audio volume control of sounds from the sound generation circuit 135 are controlled thereby the sound control switch 53 (see FIG. 1).

Figure 5:
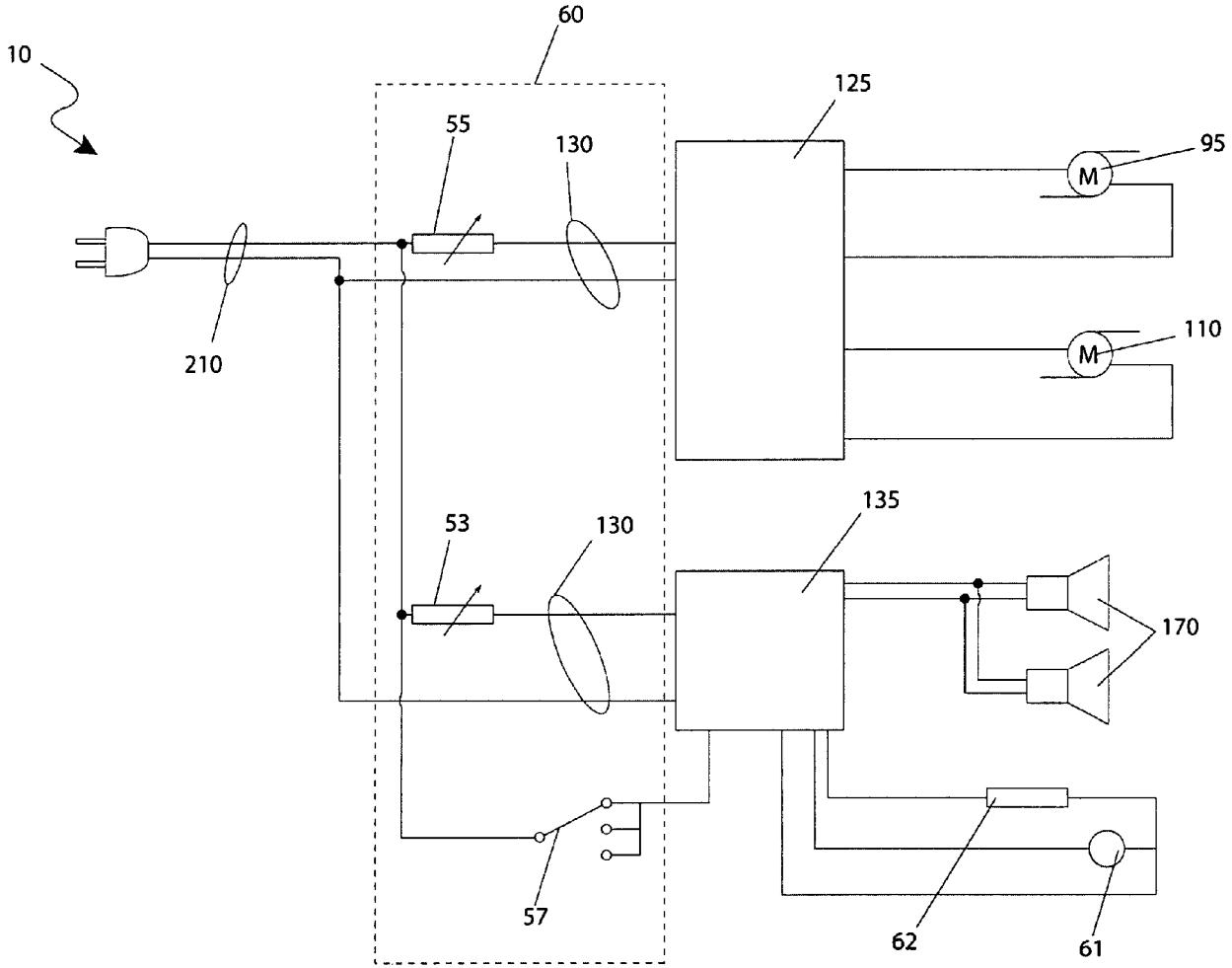

Referring now to FIG. 5, an electrical block diagram depicting the electrical components as used with the apparatus 10, according to the preferred embodiment of the present invention, is disclosed. Electrical power is obtained from a standard wall outlet 200 (as shown in FIG. 1) and conducted thereto said electrical components of the apparatus 10 via the power cable 210. Power is then routed to the motion control switch 55 and rotary sound control switch 53 independently. That is, the motion portion of the apparatus 10 may be activated independently or the sound reproduction portion of the apparatus 10 can be operated independently, or they may be operated in a simultaneous manner. The analog output of the motion control switch 55 is delivered to the drive control module 125. The variable electrical output of the drive control module 125 is directed to the x-axis electric motor 95 and the y-axis electric motor 110. The output of the sound control switch 53 is delivered to the sound generation module 135 so as to produce a desired audio volume therefrom the speakers 170. Power is also provided from the power cable 210 thereto the selector switch 57 which is in electrical communication therewith the sound generation module 135, thereby enabling user selected pre-recorded sounds such as tire noise, wind noise, and the like. Other selections available on said selector switch 57 enable connection thereto the analog 61 or digital 62 sound interfaces, thereby allowing additional audio input therefrom various peripheral audio devices. The audio output therefrom the sound generation module 135 is directed to the two (2) speakers 70.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. It is envisioned that the motion simulator for child automobile seats 10 would be fabricated in general accordance with FIGS. 1 through 5.

The method of installing the apparatus 10 may be achieved by performing the following steps: placing the apparatus 10 thereonto a flat surface such as a floor, table, grade surface; placing the conventional child automobile seat assembly 20 thereupon the platform surface portion 64 of the apparatus 10; securing the child automobile seat assembly 20 thereto the apparatus 10 by routing the seat belt portion 26 therethrough the belt slots 27 and seat belt tunnel 24 portions of the child automobile seat assembly 20; latching the two (2) strap portions of the seat belt 26 thereto each other by interlocking the female 30 and male 32 buckle portions together; pulling the strap portions of the seat belt 26 in a conventional manner until said seat belt 26 is snug; placing the child or infant thereinto the child automobile seat assembly 20; and, securing said child therein said seat assembly 20 using integral seat restraint portions 22. At this point in time, the apparatus 10 is ready for operation.

The method of utilizing the apparatus 10 may be achieved by performing the following steps: rotating the selector switch 57 thereto a desired sound or audio input device; activating the rotary motion 55 and/or sound 53 control switch portions of the apparatus 10 thereby a parent or care provider to produce a desired lateral motion 87 or longitudinal motion 89 and/or sound effect; allowing operation of the apparatus 10 for a desired period of time; turning off the apparatus 10 using the control switches 53, 55, thus returning it to its initial state for use at a later time.

Based upon a user-selected speed as selected thereupon the motion control switch 55, the motion effects 87, 89 are envisioned to vary from that of a repetitive motion which cycles back and forth similar to that of being rocked, to that of a high-frequency vibration. When operated in conjunction therewith the audible sounds produced by the sound generating module portion 135 of the apparatus 10, a restful or sleeping condition is anticipated to occur. It is envisioned that a child which has fallen asleep in an automobile, may be transferred to the apparatus 10 at the completion of a trip once therein a home to allow a nap to continue. Additionally, a child that is awake could be placed in a conventional child automobile seat 20 that is attached to the apparatus 10 inside of the home for a nap in much the same manner as a child is commonly placed in a crib, with the notable advantage of the child falling asleep faster while utilizing the apparatus 10 due to the aforementioned sound and motion effects provided. Particular settings of the motion control switch 55 are envisioned to be thereat a slow or medium setting to keep a sleeping child sleeping, and set thereto a medium or fast setting to help put a child to sleep.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A child seat automobile motion simulator comprises: a base assembly; a platform adjustably supported above said base assembly, said platform being adapted to receive an existing child automobile seat thereon; a seat belt removably strapped about said platform and being adapted to allow the child automobile seat to be affixed securely to said platform; and, a control module communicatively coupled to said base assembly; wherein said base assembly causes said platform to oscillate along a longitudinal motion and a lateral motion based upon instructions received from said control module; wherein said base assembly comprises: an upper base section having upturned outer edges forming a "U"-shaped structure that is adapted to cradle the child automobile seat; and, a lower base section integrally foxed with said upper base section; wherein said platform is located between said upturned outer edges; wherein said upper base section further comprises: a seat belt; and: first and second pluralities of loops equally-spaced along forward and rearward edges of said upper base section respectively; wherein said first and second pluralities of loops have inverted "U"-shapes; wherein said seat belt comprises: two removably joined strapping portions which are anchored to said upper base section and routed through respective belt slot formed along said upturned outer edges of said lower base section respectively; wherein said base assembly further comprises: a plurality of isolation springs connected to said upper and lower base sections respectively such that said upper base section remains spaced above said lower base section; a lower support enclosure located within said lower base section and thereby housing said control module therein; a x-axis electric motor and an x-axis eccentric element mated thereto; and, a y-axis electric motor and a y-axis eccentric element mated thereto; wherein said upper base section is supported by said isolation springs and thereby motions said upper base section in a x-axis and a y-axis defined along a horizontal plane; wherein said longitudinal and lateral directions are aligned along said x-axis and said y-axis respectively; and, wherein said upper base section moves independently from said lower base section during activation of said longitudinal and lateral motions respectively.

2. The child seat automobile motion simulator of claim 1, further comprising: a plurality of spring anchors directly coupled to said upper base section and said lower support enclosure such that said spring anchors are affixed to end portions of said isolation springs respectively.

3. The child seat automobile motion simulator of claim 2, wherein said lower support enclosure is directly coupled to said x-axis and y-axis eccentric elements respectively, said x-axis and y-axis eccentric elements being rotated by said x-axis and y-axis electric motors respectively and further being in mechanical communication therewith via vertical shafts respectively.

4. The child seat automobile motion simulator of claim 3, further comprising:

first and second slotted couplings mated to said upper base section and said x-axis and y-axis eccentric elements respectively;

wherein said first and second slotted couplings covert rotational aspects of said x-axis and y-axis eccentric elements into longitudinal and lateral motions respectively; and, wherein said first and second slotted couplings are arranged at right angles with respect to each other thereby resulting in respective longitudinal and lateral motions.

5. The child seat automobile motion simulator of claim 4, wherein each of said first and second slotted couplings comprises: a "T"-shaped slot-and-pin securely attached to a bottom surface of said upper base section.

6. The child seat automobile motion simulator of claim 5, wherein each of said x-axis and y-axis electric motors rotate said respective x-axis and y-axis eccentric elements in an eccentric manner within said slotted couplings and thereby transmits said longitudinal and lateral motions to said upper base section.

7. A child seat automobile motion simulator comprises: a base assembly adapted to be positioned on a ground surface; a platform adjustably supported above said base assembly, said platform being adapted to receive an existing child automobile seat thereon; a seat belt removably strapped about said platform and being adapted to allow the child automobile seat to be affixed securely to said platform; and, a control module communicatively coupled to said base assembly; wherein said base assembly causes said platform to oscillate along a longitudinal motion and a lateral motion based upon instructions received from said Control module; wherein said base assembly remains static while said platform is oscillated along said longitudinal and lateral motions; wherein said base assembly comprises: an upper base section having upturned outer edges forming a U-shaped structure that is adapted to cradle the child automobile seat; and, a lower base section integrally formed with said upper base section; wherein said platform is located between said upturned outer edges; wherein said upper base section further comprises: a seat belt; and, first and second pluralities of loops equally-spaced along forward and rearward edges of said upper base section respectively; wherein said first and second pluralities of loops have inverted "U"-shapes; wherein said seat belt comprises: two removably joined strapping portions which are anchored to said upper base section and routed through respective belt slot formed along said upturned outer edges of said lower base section respectively; wherein said base assembly further comprises: a plurality of isolation springs connected to said upper and lower base sections respectively such that said upper base section remains spaced above said lower base section; a lower support enclosure located within said lower base section and thereby housing said control module therein; a x-axis electric motor and an X-axis eccentric element mated thereto; and, a y-axis electric motor and a y-axis eccentric element mated thereto; wherein said upper base section is supported by said isolation springs and thereby motions said upper base section in a x-axis and a y-axis defined along a horizontal plane; wherein said longitudinal and lateral directions are aligned along said x-axis and said y-axis respectively; and, wherein said upper base section moves independently from said lower base section during activation of said longitudinal and lateral motions respectively.

8. The child seat automobile motion simulator of claim 7, further comprising: a plurality of spring anchors directly coupled to said upper base section and said lower support enclosure such that said spring anchors are affixed to end portions of said isolation springs respectively.

9. The child seat automobile motion simulator of claim 8, wherein said lower support enclosure is directly coupled to said x-axis and y-axis eccentric elements respectively, said x-axis and y-axis eccentric elements being rotated by said x-axis and y-axis electric motors respectively and further being in mechanical communication therewith via vertical shafts respectively.

10. The child seat automobile motion simulator of claim 9, further comprising:

first and second slotted couplings mated to said upper base section and said x-axis and y-axis eccentric elements respectively;

wherein said first and second slotted couplings covert rotational aspects of said x-axis and y-axis eccentric elements into longitudinal and lateral motions respectively; and, wherein said first and second slotted couplings are arranged at right angles with respect to each other thereby resulting in respective longitudinal and lateral motions.

11. The child seat automobile motion simulator of claim 10, wherein each of said first and second slotted couplings comprises:

a "T"-shaped slot-and-pin securely attached to a bottom surface of said upper base section;

wherein each of said x-axis and y-axis electric motors rotate said respective x-axis and y-axis eccentric elements in an eccentric manner within said slotted couplings and thereby transmits said longitudinal and lateral motions to said upper base section.

* * * * *